US012790817B2

(12) United States Patent
Fried

(10) Patent No.: US 12,790,817 B2
(45) **Date of Patent: *Nov. 10, 2026**

(54) PIVOTING ANCHOR PLATE SYSTEM FOR REINFORCING MASONRY WALLS

(71) Applicant: Craft Pro Masonry Restorations, Inc., Hulmeville, PA (US)

(72) Inventor: Michael Fried, Hulmeville, PA (US)

(73) Assignee: Craft Pro Masonry Restorations, Inc., Hulmeville, PA (US)

( * ) Notice: Subject to any disclaimer, the term of this patent is extended or adjusted under 35 U.S.C. 154(b) by 236 days.

This patent is subject to a terminal disclaimer.

(21) Appl. No.: 18/673,300

(22) Filed: May 23, 2024

(65) Prior Publication Data

US 2024/0309633 A1 Sep. 19, 2024

Related U.S. Application Data

(63) Continuation-in-part of application No. 18/349,625, filed on Jul. 10, 2023, now Pat. No. 12,559,958, which is a continuation-in-part of application No. 17/378,682, filed on Jul. 17, 2021, now abandoned, which is a continuation-in-part of application No. 16/920,624, filed on Jul. 3, 2020, now Pat. No. 11,421,433.

(51) Int. Cl.
*E04B 1/16* (2006.01)
*E04B 1/41* (2006.01)

(52) U.S. Cl.
CPC ..... *E04B 1/4178* (2013.01)

(58) Field of Classification Search
CPC ..... E04B 2001/3583; E04C 2003/026; F16B 5/0275; F16B 43/00
See application file for complete search history.

(56) References Cited

U.S. PATENT DOCUMENTS

| | | | | |
|---|---|---|---|---|
| 377,940 | A * | 2/1888 | Hevner | E04B 2/847 52/514 |
| 752,930 | A | 2/1904 | Silver | |
| 893,676 | A | 7/1908 | Tschantz | |
| 1,053,231 | A | 2/1913 | Schweikert | |
| 1,176,903 | A | 3/1916 | Johnston | |
| 1,684,187 | A | 9/1928 | Loening | |
| 1,761,800 | A * | 6/1930 | Preis | E04B 1/4128 52/704 |
| 1,982,088 | A | 11/1934 | White | |

(Continued)

*Primary Examiner* — Basil S Katcheves
(74) *Attorney, Agent, or Firm* — LaMorte & Associates, P.C.

(57) ABSTRACT

A system and method for reinforcing a masonry wall. An anchor plate is provided that is biased against the masonry wall using a tensioning element. The tensioning element extends through the wall and is anchored inside of the building. The anchor plate and the tensioning element are interconnected by a jointed connection that enables the anchor plate to incline independently from the tensioning element while the tensioning element biases the anchor plate against the masonry wall. This enables the anchor plate to remain flush against a masonry wall that is buckled or otherwise inclined. The jointed connection also enables the anchor plate to remain in flush contact with the masonry wall should the wall move due to damage, time, temperature and/or weather.

11 Claims, 7 Drawing Sheets

(56) References Cited

U.S. PATENT DOCUMENTS 2,405,289 A * 8/1946 Cardwell ..... E02D 29/0266 405/262
2,653,553 A 9/1953 Jacobs
3,353,312 A 11/1967 Storch
3,739,588 A * 6/1973 Schroter ..... E02D 5/76 405/262
4,021,990 A 5/1977 Schwalberg
4,596,102 A 6/1986 Catani
4,704,830 A 11/1987 Magadini
4,773,794 A 9/1988 Harke
4,790,114 A 12/1988 Falco
4,930,284 A 6/1990 Falco
5,168,681 A 12/1992 Ayrapetyan
5,384,993 A 1/1995 Phillips
5,588,270 A 12/1996 Keating
5,640,825 A 6/1997 Ehsani
5,644,889 A 7/1997 Getz
5,653,078 A * 8/1997 Kies ..... E04B 1/4121 49/504
5,669,189 A * 9/1997 Logiadis ..... E04H 9/021 52/167.6
5,845,450 A 12/1998 Larsen
5,852,907 A 12/1998 Tobin
5,953,865 A * 9/1999 Rickards ..... E04H 13/006 52/235
6,094,880 A 8/2000 Thompson
6,195,949 B1 3/2001 Schuyler
6,336,892 B1 * 1/2002 Squibb ..... A63B 3/00 52/149
6,341,917 B1 * 1/2002 Schubring ..... B29C 65/645 403/299
6,625,945 B2 9/2003 Commins
7,404,274 B2 7/2008 Hayes
7,726,093 B2 6/2010 Morton
7,748,180 B1 7/2010 Plavidal
7,765,764 B2 * 8/2010 Zambelli ..... E04B 1/215 52/223.13
7,823,354 B2 11/2010 Wheatley
7,861,469 B2 1/2011 Heady
8,375,671 B1 2/2013 Thrasher
8,555,587 B2 10/2013 Hohmann, Jr.
9,334,646 B2 5/2016 Hohmann, Jr.
9,587,363 B2 * 3/2017 Pedraza ..... E02D 5/803
10,240,340 B2 3/2019 Studer
11,421,433 B2 * 8/2022 Fried ..... E04G 23/0296
2002/0015628 A1 * 2/2002 Hartmann ..... F16B 43/00 411/161
2002/0194808 A1 12/2002 Ratliff
2004/0134140 A1 7/2004 Gaddie
2006/0080926 A1 4/2006 Resch
2006/0254193 A1 11/2006 Platts
2009/0056250 A1 * 3/2009 Bransford ..... B25B 25/00 52/223.13
2009/0158678 A1 6/2009 Ginter et al.
2010/0037552 A1 2/2010 Bronner
2010/0229492 A1 9/2010 Harkin
2012/0315081 A1 12/2012 Bouldin
2014/0215956 A1 * 8/2014 Smith ..... E04B 1/003 52/705
2015/0299999 A1 10/2015 Koblasz
2016/0032582 A1 * 2/2016 Hohmann, Jr. ..... E04B 1/4178 52/703
2017/0298611 A1 10/2017 Callahan
2018/0216337 A1 8/2018 Scotta
2019/0048577 A1 * 2/2019 Studer ..... E04B 1/003

* cited by examiner

PIVOTING ANCHOR PLATE SYSTEM FOR REINFORCING MASONRY WALLS

RELATED APPLICATIONS

This application is a continuation-in-part of U.S. patent application Ser. No. 18/349,625, filed Jul. 10, 2023, which is a continuation-in-part of U.S. patent application Ser. No. 17/378,682 filed Jul. 17, 2021, which is a continuation-in-part of U.S. patent application Ser. No. 16/920,624 filed Jul. 3, 2020, now U.S. Pat. No. 11,421,433.

BACKGROUND OF THE INVENTION

1. Field of the Invention

In general, the present invention relates to anchor plates and the methodology used when installing anchor plates. More particularly, the present invention relates to the structure of the anchor plate, the structure of the anchor that retains the anchor plate, and the methodology of installing anchor plates and anchors in preexisting walls that are in need of reinforcement.

2. Prior Art Description

Many buildings contain masonry walls that are made of brick, block, or stone. The masonry may form the structure of a wall or may just be a façade in front of a traditional lumber wall. Due to a variety of reasons, such as ground settlement, load shifting, water damage and the like, masonry walls can develop warps and buckles over time. Once a warp or buckle begins, it tends to increase in severity over time until the wall loses its structural integrity.

Recognizing that warps occur in many masonry walls, anchor plates are often added to masonry walls. Variations in anchor plate reinforcement have been in use for hundreds of years. Anchor plates are metal plates that are bolted to the lumber framework of a building through a hole in the masonry wall. The anchor plate is an enlarged plate that presses against the exterior of the masonry wall, therein preventing the masonry wall from buckling outwardly. Since the anchor plate is visible on the exterior of the wall, the anchor plate is traditionally given a decorative shape, such as a star. As such, anchor plates are also commonly referred to as star plates.

Anchor plates are held in place by a tensioning element. The tensioning element can be a bolt, cable, or rod that extends through a hole in the masonry wall and engages the lumber framework of the building. Within the building, tensioning elements are commonly anchored to multiple floor joists. This provides the anchoring strength needed to resist the pulling force of a buckled wall. When anchoring a tensioning element to a joist, the operation is fairly simple if the incoming tensioning element is perpendicular to the floor joists. If the tensioning element and floor joist are perpendicular, the tensioning tether can pass through a hole in the joist and be anchored with a washer and nut or similar anchor structure. However, if the tensioning element enters a building at an orientation that is parallel to the joists, then anchoring is far more difficult. This is especially true if a tensioning element enters into a void between the framing joists.

When a slight warp or buckle is noticed in a masonry wall, it is desirable to install an anchor plate in order to stop the warp or buckle from progressing further. However, when an anchor plate is installed, the anchor plate is rigidly installed in a vertical orientation. Any wall that is beginning to buckle or lean is typically not perfectly vertical in the areas where the anchor plates are installed. As such, the contact between the anchor plate and the wall is not flush. The anchor plate will apply different forces to the masonry wall along the periphery of the anchor plate. Over time, this uneven distribution of forces can cause the masonry wall to crack. As a result, the installation of the anchor bolt does not reinforce the buckling wall, it merely creates a buckling wall that is also cracked. This enables water to further penetrate the wall and create damage until the masonry wall fails or requires replacement. A similar problem occurs if a wall begins to buckle or lean after an anchor plate is installed. Initially, the forces applied by the anchor plate may be evenly distributed around the anchor plate. However, as the wall begins to lean, the anchor plate stays stationary and the forces being applied become asymmetrical. The imbalance in the forces only increases and the lean or buckle in the wall increases.

A need therefore exists for an improved anchor plate system that can be added to masonry walls that enables the anchor plate to orient itself to be flush with a wall that is leaning or buckled. In this manner the anchor plate will continue to apply corrective forces to the wall even as the wall continues to lean or buckle. This need is met by the present invention as described and claimed below.

SUMMARY OF THE INVENTION

The present invention is a system and method for reinforcing a masonry wall. An anchor plate is provided that contacts the masonry wall. The anchor plate is biased against the masonry wall using a tensioning element. The tensioning element extends through the wall and is anchored to at least one of the joists on the inside of the building. The anchor plate and the tensioning element are interconnected by a jointed connection that enables the anchor plate to incline independently from the tensioning element while the tensioning element biases the anchor plate against the masonry wall. This enables the anchor plate to remain flush against a masonry wall that is buckled or otherwise inclined. The jointed connection also enables the anchor plate to remain in flush contact with the masonry wall should the wall move due to damage, time, temperature and/or weather.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention anchor plate reinforcement system can be embodied in many ways, only a few exemplary embodiments are illustrated. The exemplary embodiments are shown for the purposes of explanation and description. The exemplary embodiments are selected in order to set forth some of the best modes contemplated for the invention. The illustrated embodiments, however, are merely exemplary and should not be considered limitations when interpreting the scope of the appended claims.

Figure 1:
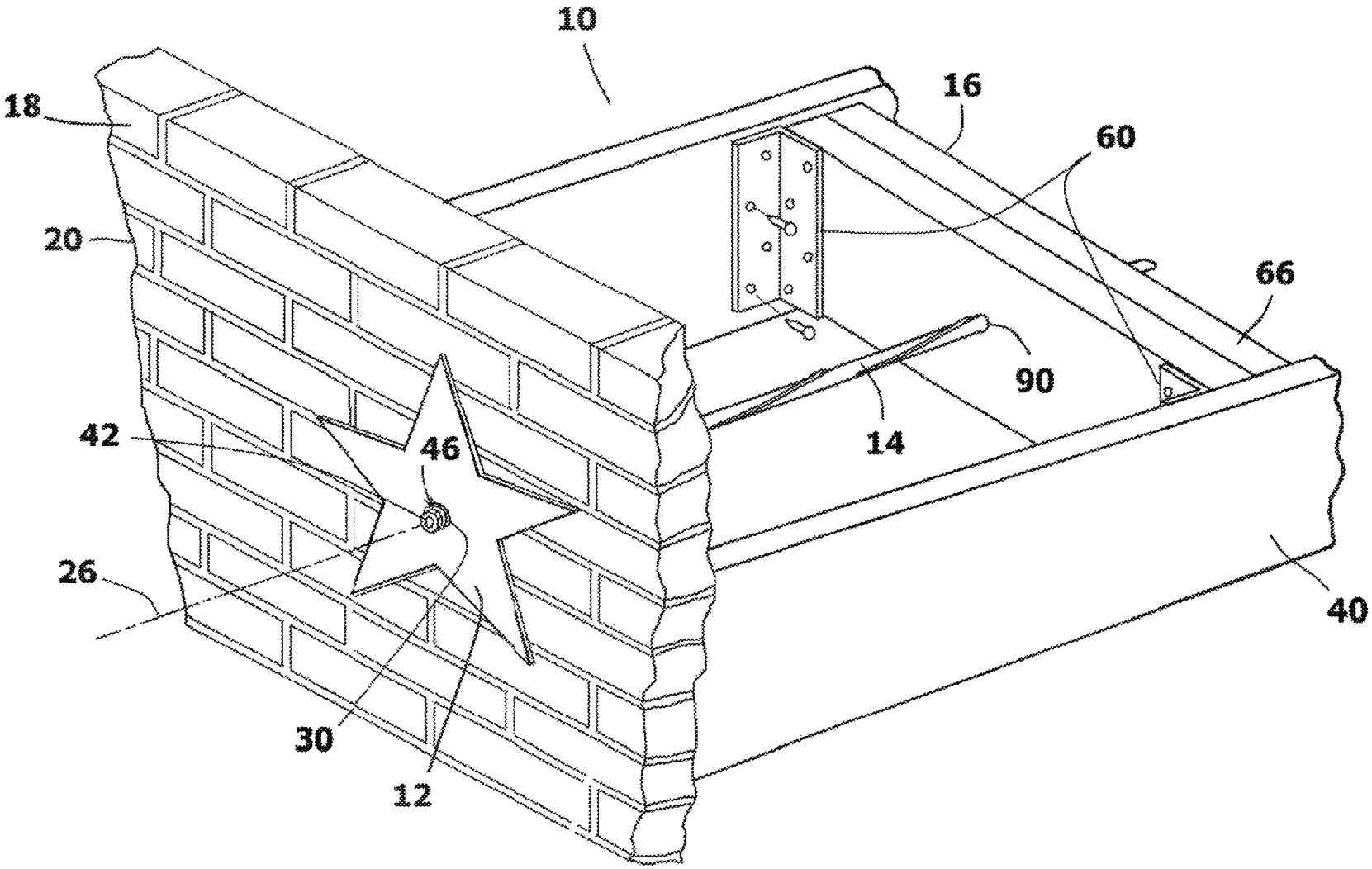
FIG. 1 is a fragmented view of a masonry wall containing an exemplary embodiment of the present invention reinforcement system.
Figure 2:
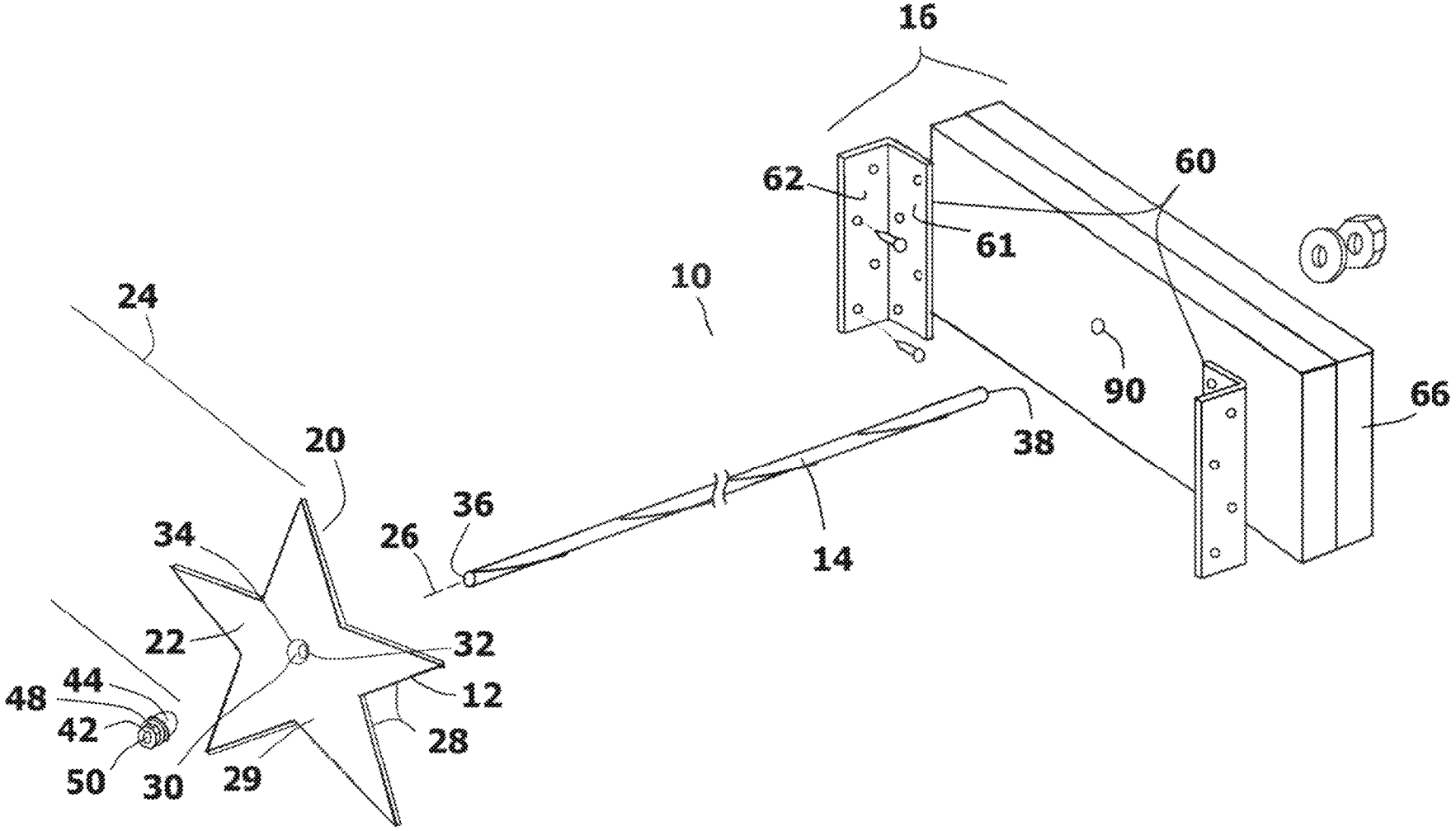
FIG. 2 is a top view of the exemplary embodiment of FIG. 1.

Referring to FIG. 1 and FIG. 2, an improved masonry wall reinforcement system 10 is shown. The masonry wall reinforcement system 10 includes an anchor plate 12, a tensioning element 14, and a joist anchoring assembly 16. As will be explained, the tensioning element 14 and the anchoring assembly 16 can be built into a new building or retroactively added to an existing building 20. The anchor plate 12 is attached to the tensioning element 14 and is biased against a masonry wall 18 by the tensioning element 14. This reinforces the masonry wall 18 and prevents the masonry wall 18 from further deflecting in the area of the anchor plate 12.

The anchor plate 12 has a contact surface 20 and a face surface 22. The face surface 22 is oriented away from the masonry wall 18 and can be ornamental. The contact surface 20 of the anchor plate 12 is flat and presses against the masonry wall 18. The contact surface 20, being flat, has a contact plane 24. The tensioning element 14 engages the geometric center of the anchor plate 12. The tensioning element 14 extends along a mid-axis 26. If the masonry wall 18 is vertical, the contact plane 24 of the anchor plate 12 is perpendicular to the mid-axis 26 of the tensioning element 14. However, as will be explained, the connection between the tensioning element 14 and the anchor plate 12 is jointed. This enables the anchor plate 12 to wobble about its connection with the tensioning element 14. Accordingly, the contact plane 24 of the anchor plate 12 can change relative to the mid-axis 26 of the tensioning element 14. This enables the anchor plate 12 to lay flush and remain flush against a masonry wall 18 that is actively leaning or buckling with changes in time, temperature, and weather.

In the illustrated embodiment, the anchor plate 12 has a plurality of arms 28 that radially extend from a central hub 29. In the shown embodiment, the anchor plate 12 is star-shaped having eight arms 28. However, it should be understood that other shapes such as circles, cross shapes, and varying polygonal stars can also be used. The anchor plate 12 can be made of a variety of materials, but is preferably made of stainless steel, galvanized steel, bronze, or some other high strength metal alloy that is resistant to rust and is capable of being exposed to the elements for decades.

A socket relief 30 is formed in the geometric center of the anchor plate 12. In the shown embodiment of a star, the geometric center is located in the middle of the central hub 29. The socket relief 30 is a concavity that has a radius of curvature. The socket relief 30 is intended to serve as the sock in a ball and socket joint. The socket relief 30 can be accessed through the contact surface 20 of the anchor plate 12 by a small opening 32. The socket relief 30 can also be accessed from the face surface 22 of the anchor plate 12 via a second larger opening 34.

The tensioning element 14 can be a helical rod, a masonry tie, a steel bolt, a steel rod, a chain, a cable, or a strap. The tensioning element 14 has a first end 36, a second end 38, and a length between the ends 36, 38. The second end 38 of the tensioning element 14 is inserted into the structure of the building 20 through the masonry wall 18. The length of the tensioning element 14 depends upon the features of the masonry wall 18 and the lumber framework within the building. In the shown embodiment, the framework within the building includes joists 40. The joists 40 are oriented at a perpendicular to the masonry wall 18. The joists 40 are typically spaced either sixteen inches or twenty-four inches apart. Accordingly, there are void spaces between the joists 40. The anchoring assemblies 16 are set into the void spaces between the joists 40.

The tensioning element 14 extends from the anchoring assembly 16, out beyond the masonry wall 18. The anchor plate 12 is advanced over the tensioning element 14. The first end 36 of the tensioning element 14 extends through the small opening 32 on the anchor plate 12 and into the socket relief 30. A ball nut 42 is attached to the tensioning element 14. The ball nut 42 has a rounded section 44 that passes into the socket relief 30. The rounded section 44 of the socket relief 30 has a rounded exterior that matches the radius of curvature of the socket relief 30. In this manner, when the rounded section 44 of the ball nut 42 passes into the socket relief 30 of the anchor plate 12, a ball and socket joint 46 is created. The ball and socket joint 46 enables the anchor plate 12 to wobble about the ball nut 42 without ever disengaging from the ball nut 42.

The ball nut 42 also has a second section 48 that is too large to pass into the socket relief 30. An opening 50 passes through the center of the ball nut 42 that enables the ball nut 42 to pass onto the tensioning element 14. If the tensioning element 14 is threaded or is a helical rod, the opening 50 in the ball nut 42 is internally threaded in a manner that enables the ball nut 42 to thread onto the tensioning element 14. If the tensioning element 14 is a length of cable, chain, or a solid rod, then the ball nut 42 can be welded to the tensioning element.

The tensioning element 14 attaches the anchor plate 12 to the joist anchoring assembly 16. In the shown embodiment, the joist anchoring assembly 16 has a set of two brackets 60. Each of the brackets 60 is made from a length of steel angle iron that has an L-shaped profile. Each of the brackets 60 has two legs 61, 62, which include the mounting leg 61 and the free leg 62. Bolt holes 64 are formed in both the mounting leg 61 and the free leg 62.

The brackets 60 are mounted to joists 40 on opposite sides of the same void space. The brackets 60 are mounted to the joists 40 at the same distances from the masonry wall 18. The mounting leg 61 of each bracket 60 is bolted to the joists 40 by extending a bolt or similar connector through the bolt holes and into the joists 40. The bolts can be extended through the joists 40 and be set with washers and nuts. Alternatively, the bolts can be lag bolts that terminate in the joists 40, as is illustrated.

Once the brackets 60 are joined to the joists 40, the free legs 62 of each of the brackets 40 extend into the void space between the joists 40. The void space has a width between the opposing joists 40. A length of beam 66 is provided. The length of beam 66 has a length that is equal to, or slightly smaller than, the width between the joints 40. The length of beam 66 can be a length of a metal beam, such as an I-beam. However, the length of beam 66 is preferably made from one or more cut lengths of construction lumber or engineered lumber. If construction lumber is used, as is illustrated, it is preferred that the length of beam 66 be made from at least two cut lengths that are glued and/or nailed together. The length of beam 66 is positioned to span the void space between the joists 40. The length of beam 66 is then bolted to the free legs 62 of the brackets 60 so that the brackets 60 are between the length of beam 66 and the masonry wall 18.

Figure 3:
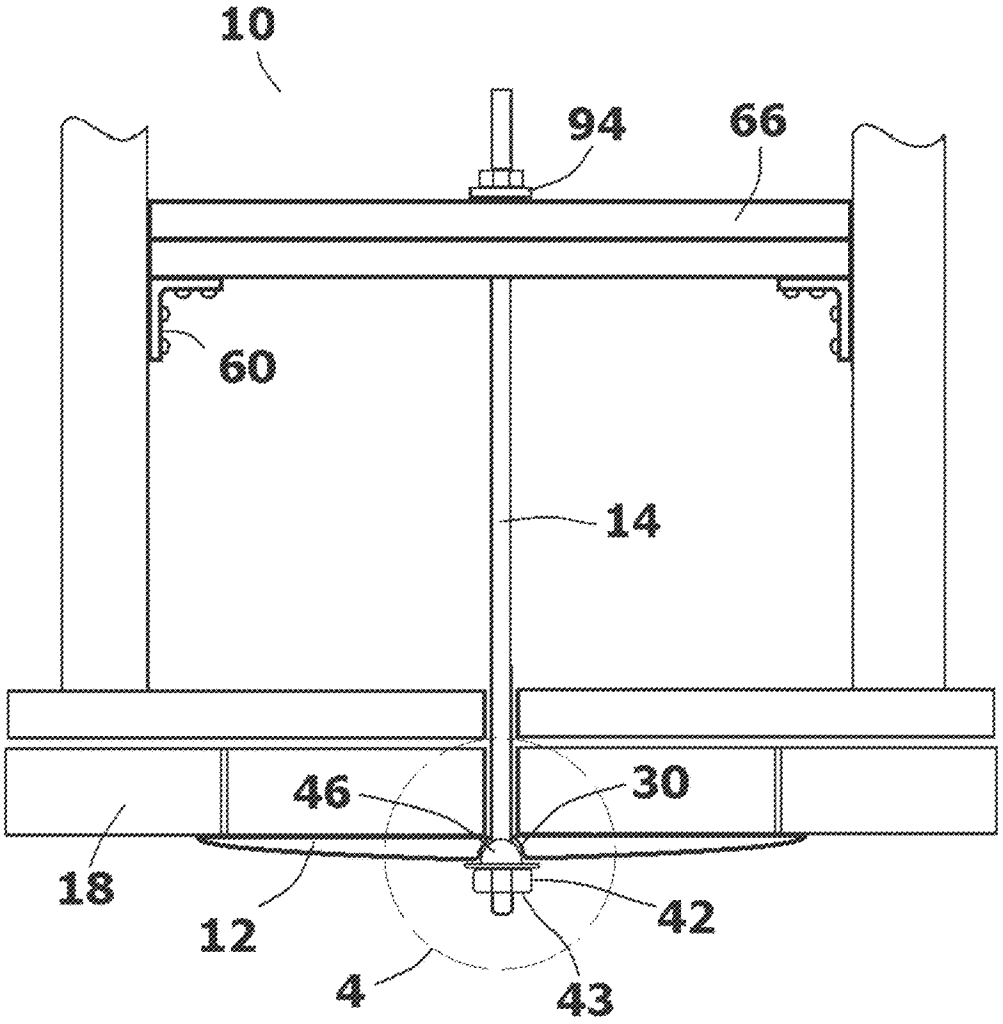
FIG. 3 is an exploded view of the jointed connection between the anchor plate and the tensioning element that is part of the present invention reinforcement system.
Figure 4:
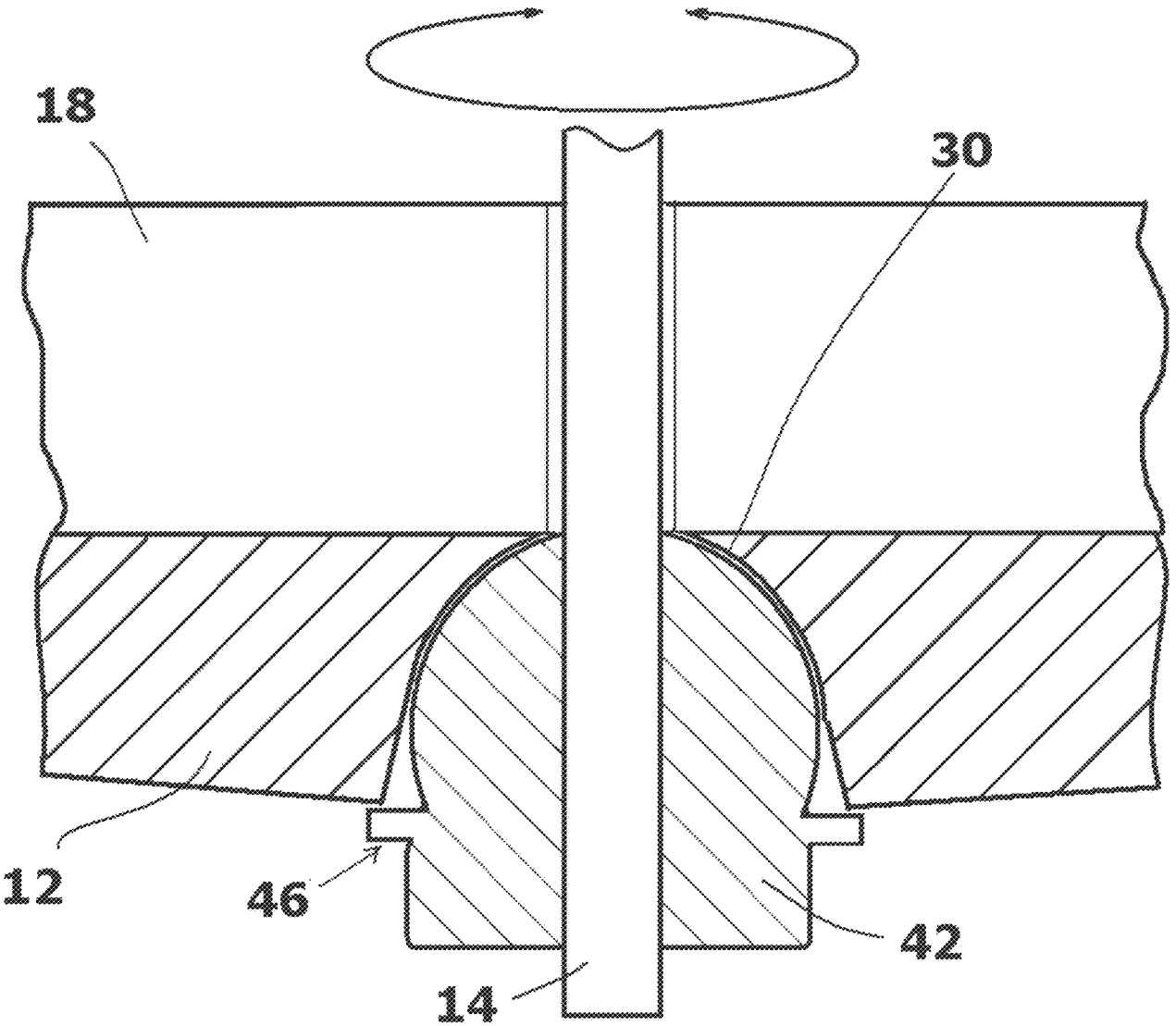
FIG. 4 is a cross-sectional view of the jointed connection of FIG. 3 shown in an assembled condition.

Referring to FIG. 3 and FIG. 4, it can be seen that the ball nut 42 and the socket relief 30 form a ball and socket joint 46. The ball and socket joint 46 enables the anchor plate 12 to angle in any direction while maintaining uniform contact with the masonry wall 18. The angle of inclination of the anchor plate 12 can change with the masonry wall 18 as the masonry wall 18 moves with time, temperature and/or weather. Regardless to the angle of the masonry wall 18 and the angle of the anchor plate 12, the distance between the ball and socket joint 46 and the joist anchoring assembly 16 remains constant.

Figure 5:
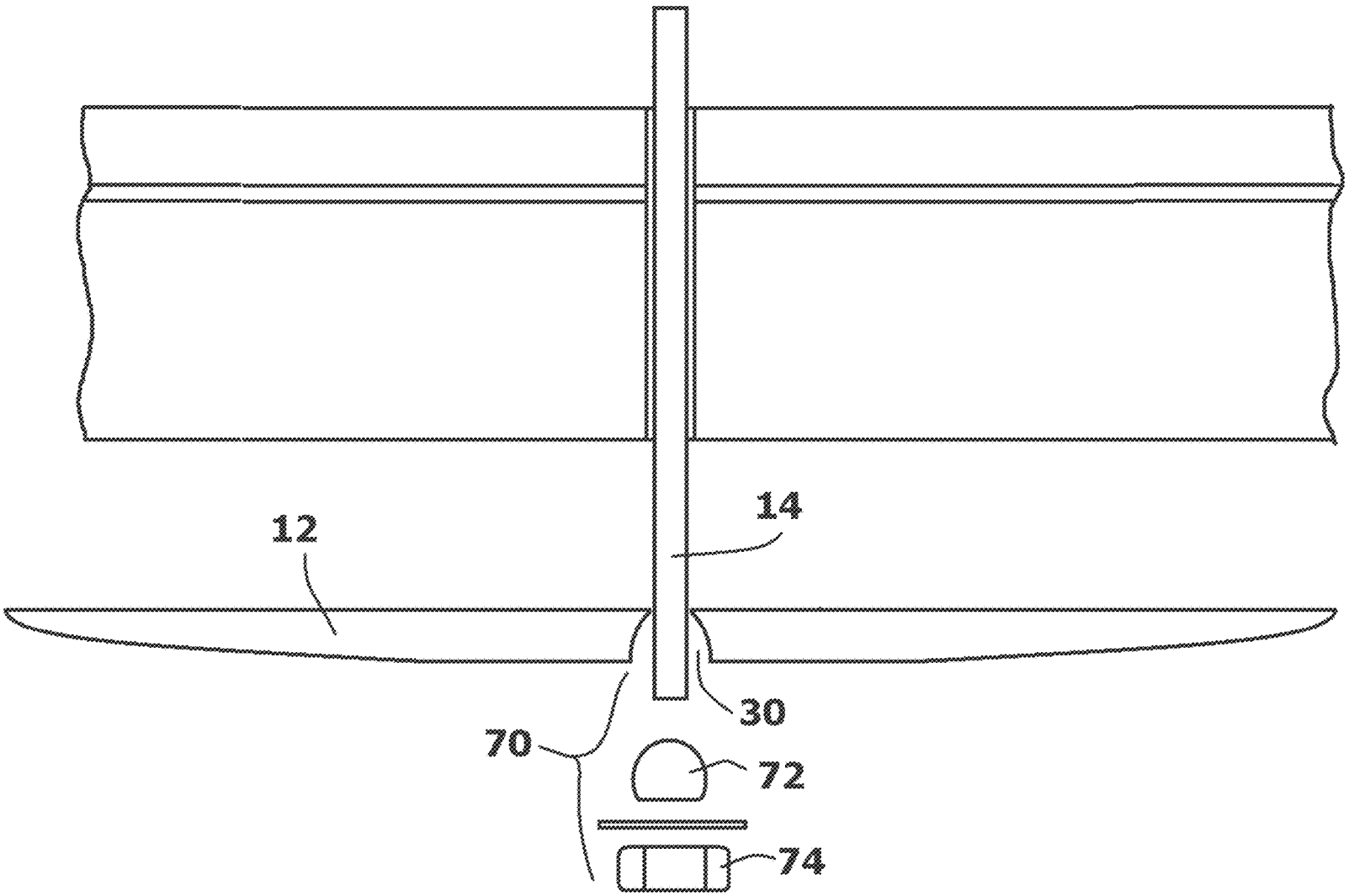
FIG. 5 is an alternate embodiment for the jointed connection that joins the anchor plate to the tensioning element.

Referring to FIG. 5. an alternate embodiment for forming a ball and socket joint 70 is shown. The anchor plate 12 and the tensioning element 14 are the same as has been previously described and the same parts are identified with the same reference numbers. In this embodiment, a separate ball 72 and a separate nut 74 are provided. The ball 72 passes around the tensioning element 14 and passes into the socket relief 30 on the anchor plate 12. The nut 74 tightens on the tensioning element 14 and engages the ball 72, therein locking the ball 72 in place. The ball 72 and the socket relief 30 create a ball and socket joint 70 that enables the anchor plate 12 to incline relative to the tensioning element 14.

Figure 6:
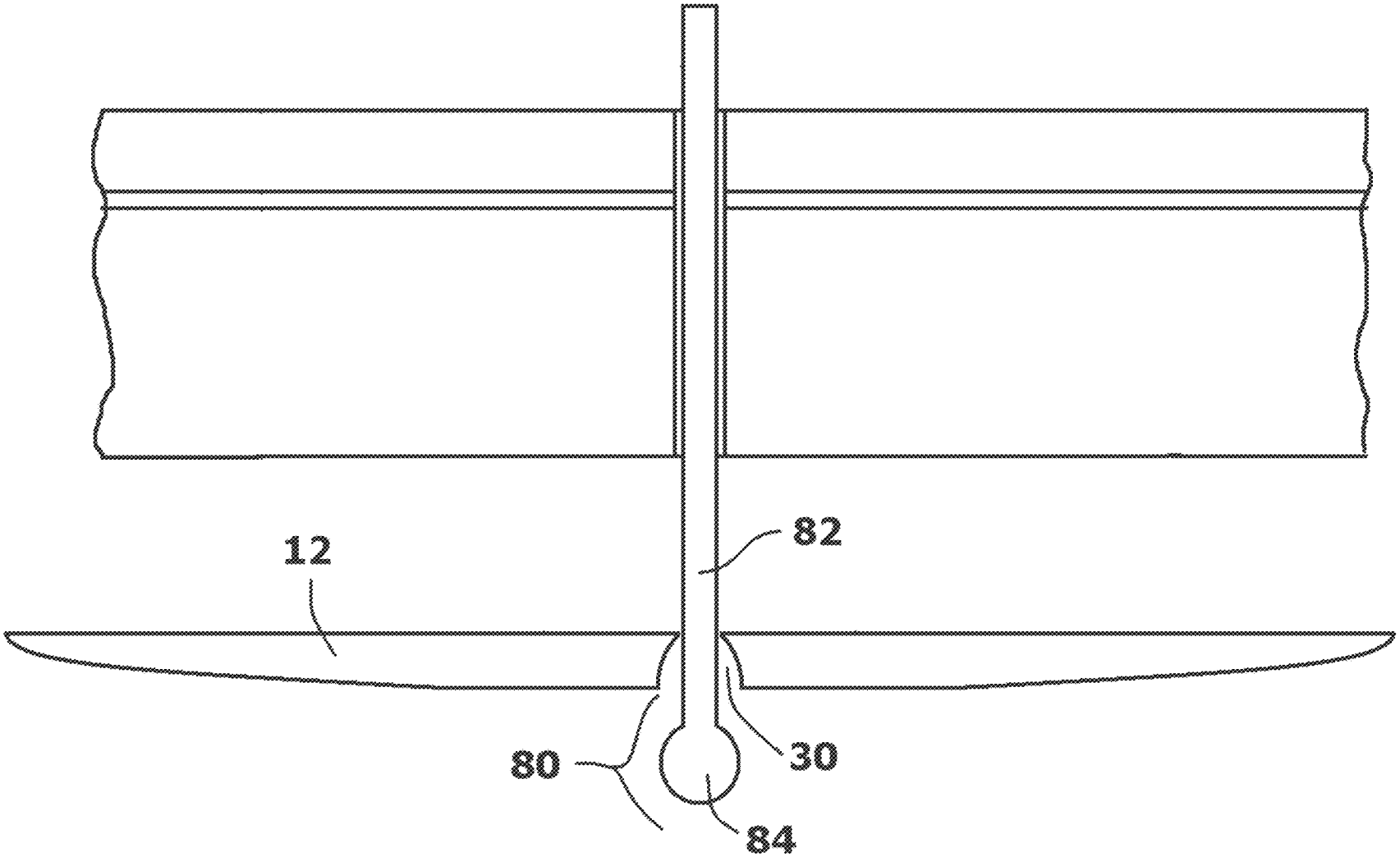
FIG. 6 is an alternate embodiment for the jointed connection that joins the anchor plate to the tensioning element.

Referring to FIG. 6, an alternate embodiment of a ball and socket joint 80 is shown. The anchor plate 12 is the same and is identified with the same reference number. In this embodiment, a tensioning element 82 terminates with an enlarged head 84 that is shaped as a ball. As the tensioning element 82 is tightened, the enlarged head 84 enters the socket relief 30 creating the ball and socket joint 80. The ball and socket joint 80 enables the anchor plate 12 to incline relative to the tensioning element 82.

Referring to FIG. 3 in conjunction with FIG. 1 and FIG. 2, it will be understood that to install the masonry wall reinforcement system 10, an access hole 90 is made in the masonry wall 18 to accommodate the tensioning element 14. If the tensioning element 14 is a rod, bolt or cable, the access hole 90 is drilled through the masonry wall 18. If the tensioning element 14 is a helical tie or helical rod, the tensioning element 14 can be directly driven through the masonry wall 18. Once installed, the tensioning element 14 has its first end 36 outside the building 20 and its second end 38 in the void space between the joists 40.

The first end 36 of the tensioning element 14 is accessible on the outside of the masonry wall 18. The first end 36 of the tensioning element 14 is advanced through the anchor plate 12. The tensioning element 14 is terminated with the ball nut 42. The second end 38 of the tensioning element 14 is disposed in the void space between the joists 40. The brackets 60 are installed on the opposing joists 60. The length of beam 66 is then set in place. A hole 90 is drilled through the length of beam 66 to accommodate the passage of the tensioning element 14 through the length of beam 66. If the tensioning element 14 is a helical tie or helical rod, the tensioning element 14 can be directly driven through the length of beam 66. Once the tensioning element 14 is advanced through the length of beam 66, a nut and washer set 94 are then used to tighten the tensioning element 14 against the length of beam 66. As the tensioning element 14 tightens, the ball and socket joint 46 is set and the anchor plate 12 is biased against the masonry wall 18.

Figure 7:
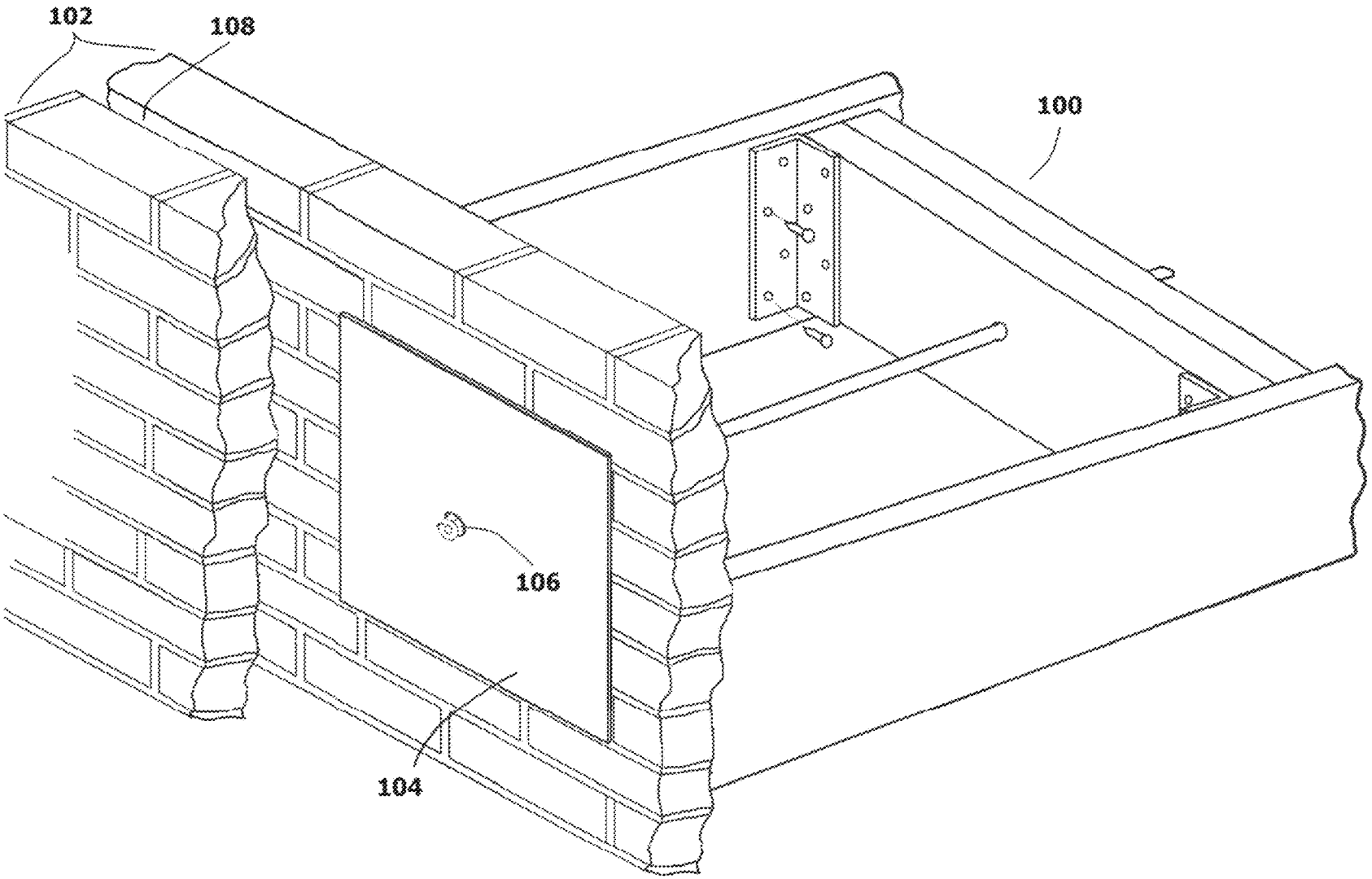
FIG. 7 is a fragmented view of a two-course wall in a building in which an alternate embodiment of the reinforcement system is installed.

Referring to FIG. 7, an alternate embodiment of the reinforcement system 100 is shown. In this embodiment, the masonry wall 102 has two courses of brick that are interlocked with joining bricks. Such wall construction was commonplace from the mid-1800's to the mid-1900's. In the shown system, a plain anchor plate 104 is utilized because the presence of the anchor plate 104 is being hidden. The anchor plate 104 is a simple plate of steel or stainless steel containing a socket relief 106.

The anchor plate 104 is placed in a gap 108 between the first course of brick 68 and second course of brick. This is accomplished by creating an opening in the first course of brick, inserting the anchor plate 104 and tensioning element 110. The opening in the first course of brick is then repaired. Thus, the wall is reinforced without the anchor plate 104 being visible.

It will be understood that the embodiments of the present invention that are illustrated and described are merely exemplary and that a person skilled in the art can make many variations to those embodiments. For instance, the size, thickness and length of the anchor plates and tensioning elements can be varied to meet the needs and aesthetics of a particular building. All such embodiments are intended to be included within the scope of the present invention as defined by the claims.

What is claimed is:

1. In a building having joists and walls, a system for reinforcing a wall, comprising:

an anchor plate having a face surface and a flat contact surface, wherein said flat contact surface is in flush contact with said wall;

socket relief formed into said face surface of said anchor plate, wherein said socket relief is a concavity with a radius of curvature;

an opening formed though said flat contact surface of said anchor plate that extends into said socket relief;

a tensioning element that extends through said wall and is anchored to at least one of said joists, wherein said tensioning element extends through said opening and into said socket relief; and a ball nut having a first section and a second section, wherein said first section is rounded and sized to be received within said socket relief and said second section is too large to pass into said socket relief, wherein said ball nut engages said tensioning element to bias said first section of said ball nut into said socket relief forming a joint connection that enables said anchor plate to incline independently from said tensioning element while said tensioning element biases said anchor plate against said wall.

2. The system according to claim 1, herein said jointed connection created by said ball nut engaging said socket relief is a ball and socket joint.

3. The system according to claim 2, wherein said anchor plate has a geometric center and said ball and socket joint engages said anchor plate at said geometric center.

4. The system according to claim 1, wherein said ball nut threads onto said tensioning element.

5. The system according to claim 1, wherein said tensioning element is anchored in said building to a beam that extends between two of said joists.

6. The system according to claim 1, wherein said wall is the inner wall of a two course brick wall.

7. A method of reinforcing a wall of a building comprising the steps of:

providing an anchor plate having a face surface and a flat contact surface, wherein a socket relief is formed into said face surface having a concavity with a radius of curvature;

providing an opening formed though said flat contact surface of said anchor plate that extends into said socket relief;

providing a ball nut having a first section and a second section, wherein said first section is rounded and sized to be received within said socket relief and said second section is too large to pass into said socket relief, providing a tensioning element that extends into said socket relief through said opening in said flat contact surface;

engaging said tensioning element with said ball nut to bias said first section of said ball nut into said socket relief forming a jointed connection that enables said anchor plate to incline relative to said tensioning element; and extending said tensioning element through said wall and anchoring said tensioning element within said building, wherein said tensioning element biases said anchor plate against said wall.

8. The method according to claim 7, wherein said jointed connection formed by said ball nut engaging said socket relief forms a ball and socket joint.

9. The method according to claim 8, wherein said anchor plate has a geometric center and said ball and socket joint engages said anchor plate at said geometric center.

10. The method according to claim 7, wherein said ball nut threads onto said tensioning element.

11. The method according to claim 7, further including anchoring said tensioning element to a beam in said building.

* * * * *